United States Patent [19]

Kwolek

[11] 4,336,672

[45] Jun. 29, 1982

[54] CENTRIFUGAL BLASTING APPARATUS

[75] Inventor: William S. Kwolek, Manchester, Mich.

[73] Assignee: Ervin Industries, Inc., Ann Arbor, Mich.

[21] Appl. No.: 141,947

[22] Filed: Apr. 21, 1980

[51] Int. Cl.[3] ..... B24C 7/00

[52] U.S. Cl. ..... 51/432; 239/655; 239/214.25; 239/224

[58] Field of Search ..... 51/432–435; 239/655, 684, 214.25, 222, 222.11, 224, 590

[56] References Cited

U.S. PATENT DOCUMENTS

| | | | |
|---|---|---|---|
| 2,170,831 | 8/1939 | Minich | 51/433 |
| 2,204,587 | 6/1940 | Guendling | 51/432 |
| 2,204,610 | 6/1940 | Minich | 51/432 |
| 2,254,234 | 9/1941 | Minich | 51/433 |
| 3,678,629 | 7/1972 | Leliaert | 51/434 |

FOREIGN PATENT DOCUMENTS

| | | | |
|---|---|---|---|
| 521933 | 4/1953 | Belgium | 51/432 |
| 510681 | 8/1939 | United Kingdom | 51/432 |
| 626945 | 8/1978 | U.S.S.R. | 51/435 |

*Primary Examiner*—Nicholas P. Godici
*Attorney, Agent, or Firm*—Olsen and Stephenson

[57] ABSTRACT

Centrifugal blasting apparatus comprising a rotatably supported blasting wheel having a plurality of radially extending impeller blades positioned adjacent the periphery of the wheel. The blades are relatively short and have their inner ends spaced a uniform and substantial distance short of the axis of rotation of the wheel so as to define an abrasive supply space between the inner ends of the blades. A tubular member extends into the abrasive supply space for delivering abrasive onto the impeller blades and comprises a main passageway portion having an axis generally parallel to and spaced radially outwardly from the axis of rotation of the blasting wheel and a discharge extension on the inner end of the main portion extending radially outwardly and terminating in a discharge opening adjacent to and in a closely spaced relationship with the inner ends of the blades. Pressurized air propels the abrasive through the tubular member onto the impeller blades.

4 Claims, 2 Drawing Figures

CENTRIFUGAL BLASTING APPARATUS

BACKGROUND OF THE INVENTION

Figure 1:
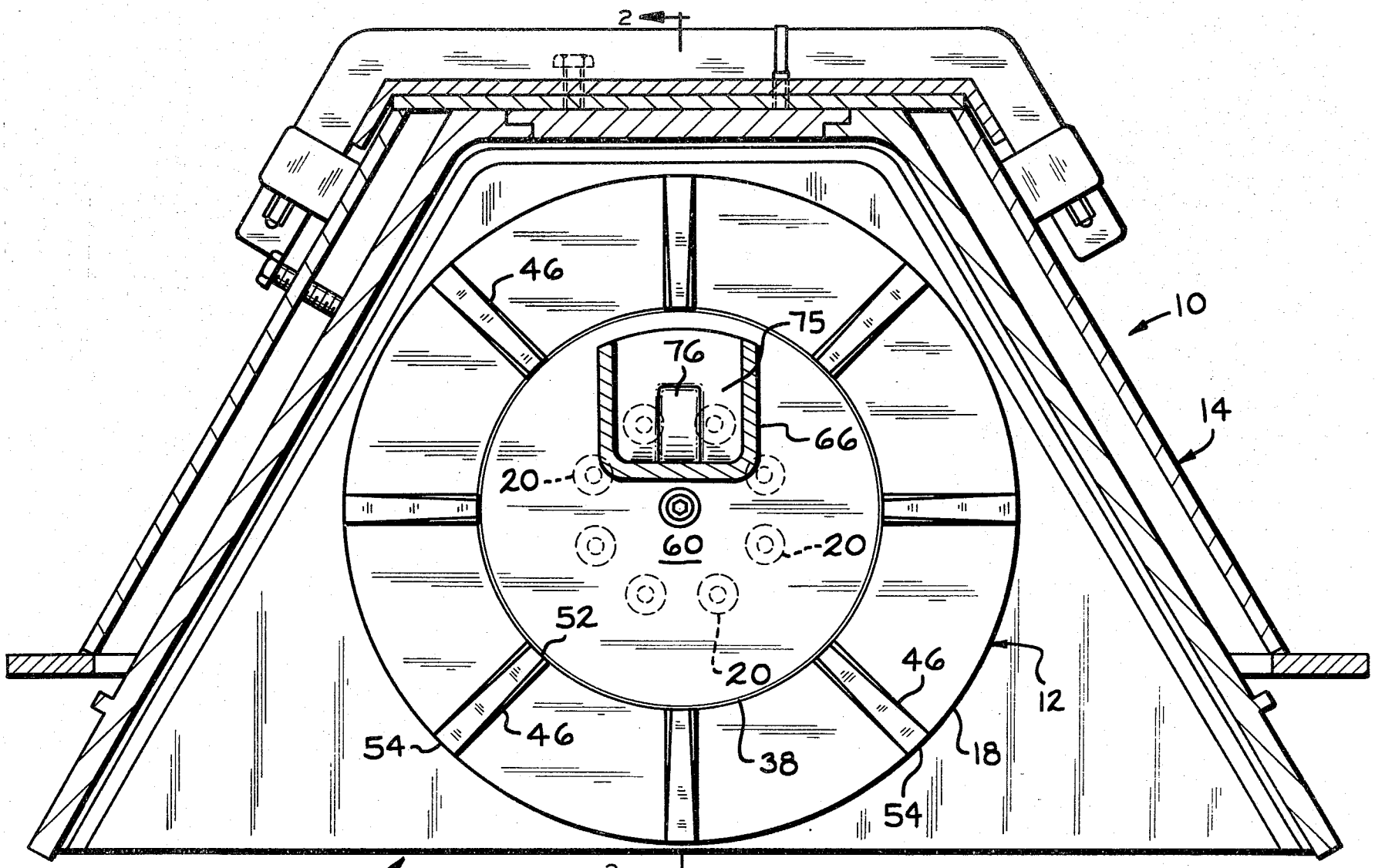

The present invention relates generally to a centrifugal blasting machine, and more particularly, to an improved blasting wheel assembly and structure for feeding abrasive to the wheel assembly.

Centrifugal blasting wheels usually consist of a rotatably supported wheel assembly having circumferentially spaced apart impeller blades extending radially with respect to the axis of rotation of the wheel assembly. Each impeller blade has an outer end that terminates adjacent the periphery of the wheel and an inner end that is spaced radially from the axis of rotation of the wheel. The inner ends of the impeller blades define a central abrasive supply space into which abrasive, usually particulate shot, is fed for discharge onto the impeller blades.

Generally, two methods are employed for feeding abrasive onto the impeller blades. The first method uses a rotatable impeller unit positioned in the abrasive supply space for propelling abrasive onto the inner ends of the impeller blades. Such an impeller unit is disclosed in U.S. Pat. No. 3,290,827 wherein a mechanically driven impeller throws the shot onto the impeller blades. The significant problem with an impeller of this type is that it wears resulting in a changing feed of shot to the impeller blades which in turn results in an undesirable blast pattern on the work. Consequently, hot spots and over-blast problems occur early in the life of the blasting machine.

The second method of feeding abrasive onto the impeller blades uses a pneumatic feed system, such as the feed system disclosed in U.S. Pat. No. 2,590,576. The pnuematic feed system of this type uses pressurized air to propel the abrasive onto the impeller blades and usually includes a tubular member having a main portion whose axis is coaxial with the axis of rotation of the wheel assembly and a discharge extension extending radially outwardly with respect to the main portion and having a discharge opening terminating adjacent to and in close proximity to the inner ends of the blades. Abrasive is gravity fed to the tubular member and pressurized air is supplied to the tubular member to propel the abrasive through the tubular member onto the impeller blades. Because the main portion of the tubular member is aligned with the axis of rotation of the wheel assembly, a substantial amount of energy must be expended in imparting a sufficient initial velocity to the abrasive to propel it onto the impeller blades. Also, conventional impeller blades as disclosed in U.S. Pat. No. 2,590,576 are relatively long so that control of the abrasive as it moves along the impeller blade is reduced thereby reducing the control of the blast pattern which sometimes results in less than an optimal blast pattern.

It is the object of the present invention, therefore, to provide an improved centrifugal blasting machine characterized by relatively short impeller blades and a pneumatic feed system requiring reduced energy to propel the abrasive onto the impeller blades.

SUMMARY OF THE INVENTION

The present invention provides an improved centrifugal blasting machine having a rotatably supported wheel assembly which includes radially extending and relatively short impeller blades circumferentially spaced apart on the wheel assembly. Each impeller blade has an outer end positioned adjacent the periphery of the wheel and an inner end terminating at a predetermined distance short of the axis of rotation of the wheel assembly. The length of each blade is less than half the distance from its outer end to the axis of rotation of the wheel assembly. The impeller blades are spaced uniform distances from the axis of the wheel assembly so that their inner ends define a central abrasive supply space to which abrasive is fed for discharge onto the impeller blades.

The present invention employs an improved pneumatic feed system having a tubular member extending into the abrasive supply space on the wheel assembly. The tubular member comprises a main passageway portion having an axis extending parallel to and displaced radially outwardly from the axis of rotation of the wheel assembly. The tubular member includes a discharge extension extending generally at right angles to the main portion so as to extend radially outwardly from the axis of rotation of the wheel assembly. The discharge extension terminates in a discharge opening positioned adjacent to the inner ends of the impeller blades and facing radially outwardly from the axis of rotation of the wheel assembly.

Abrasive is gravity fed to the tubular member and pressurized air is supplied to the tubular member to propel the abrasive through the tubular member and onto the impeller blades. A hopper for containing the abrasive supply has an outlet located in close proximity to the discharge extension on the tubular member. Consequently, the location at which the pressurized air mixes with the abrasive is in close proximity to the discharge orifice which efficiently uses the pressurized air because the abrasive is carried only a short distance. Use of the short impeller blades enables locating the tubular member away from the axis of rotation of the wheel assembly so that a reduced amount of energy in generating the pressurized air is required to propel the abrasive onto the impeller blades. Use of the short impeller blades results in a more controllable blast pattern discharging from the blasting machine because the abrasive traverses relatively short distances on the blade before being thrown against the work.

Figure 2:
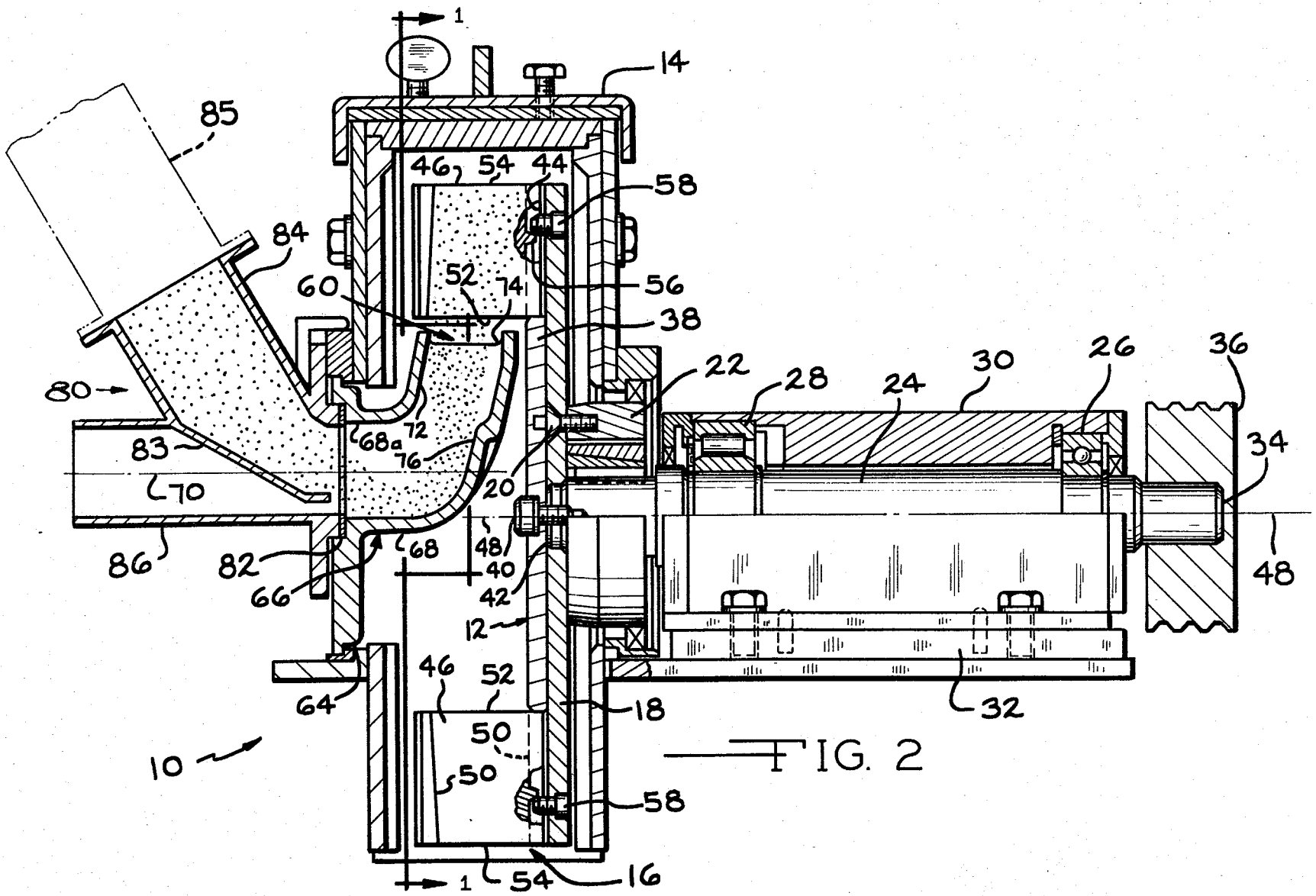

Further objects, features and advantages of the present invention will become apparent from a consideration of the following description, the appended claims and the accompanying drawing in which:

FIG. 1 is a sectional end view of the centrifugal blasting apparatus of the present invention with portions cut away from the purpose of clarity and taken substantially from line 1—1 in FIG. 2; and FIG. 2 is a sectional side view of the centrifugal blasting apparatus of the present invention taken substantially from line 2—2 in FIG. 1.

Referring to the drawing, the centrifugal blasting apparatus of the present invention, indicated generally at 10, is shown in FIGS. 1 and 2 as consisting of a throwing wheel assembly 12 rotatably supported in a housing 14 having a bottom opening 16 through which abrasive in the form of particulate shot is propelled against the work (not shown). The wheel assembly 12 includes a mounting plate 18 secured by screws 20 to a hub 22 (FIG. 2) that in turn is secured to a drive shaft 24. The drive shaft 24 is journaled in spaced-apart bearing units 26 and 28 which are mounted in a shaft carrier 30 that is secured to a base 32. The end 34 of the drive shaft 24 carries a pulley 36 which when connected to a motor (not shown) operates to rotate the drive shaft 24 and the wheel assembly 12.

The wheel assembly 12 also includes a circular locating plate 38 secured by a screw 40 to the end 42 of the drive shaft 24. The mounting plate 18 is provided with circumferentially spaced apart and radially extending slots 44 into which are positioned impeller blades 46 so that the blades are uniformly spaced apart about the axis of rotation 48 of the wheel assembly 12.

Each impeller blade 46 has side rails 50 tapering inwardly toward each other from its inner end 52 toward its outer end 54. The impeller blades 46 are mounted on the mounting plate 18 by sliding each into its corresponding slot 44 in a radially inward direction until they engage the outer edge of the locating plate 38. The inside rail 50 has a shoulder portion 56 which is engaged by a locking screw 58 that is threaded through the backside of the mounting plate 18 to hold the impeller blade 46 against the locating plate 38. The cooperating tapering surfaces on the screw 58 and the shoulder 56 produces a wedging action when the screw 58 is secured against the shoulder 56 to force the impeller blade 46 radially inwardly against the outer edge of the locating plate 38.

In the present invention, the impeller blade 46 is of relatively short length. A shortened impeller blade produces an improved shot blast pattern, namely one that is more precise and more controllable because the abrasive travels over a shorter distance on the blade before it is discharged from the blasting machine 10. In the present invention, the length of each impeller blade is less than one half the distance from its outer end 54 to the axis of the wheel assembly 12. In other words, the radial distance from the axis 48 to the inner end 52 is greater than the length of the impeller blade 46 between its inner end 52 and its outer end 54.

The inner ends 52 of the impeller blades 46 define a circular abrasive supply space 60 into which is fed abrasive from an abrasive feed unit 80. The housing 14 has a front opening 64 through which extends a tubular member 66 having a main portion 68 with an axis 70 that extends parallel to and is displaced outwardly from the axis 48 of the wheel assembly 12. In the illustrated embodiment, the axis 70 is located above the axis 48. The tubular member 66 also includes a discharge extension 72 which extends radially upwardly from the axis 70 and the axis 48. The discharge extension 72 terminates in a discharge opening 74 adjacent to the inner ends 52 of the impeller blades 46 and faces radially outwardly with respect to the axis 48. The size of the discharge opening 74 is less than the circumferential distance between the ends 52 of adjacent impeller blades 46. A rectangular deflecting projection 76 is formed integral with and centrally of the discharge extension 72 and extends generally transversely and radially outwardly with respect to the axis 70. The deflecting projection 76 aids in distributing the abrasive evenly over the impeller blades 46. As seen in FIG. 2, the deflecting projection 76 projects inwardly from the upright end wall 75 (FIG. 1) and terminates at its outer edge at a location generally aligned with the wall portion 68*a* of the tubular member 66.

The abrasive feed spout and air supply unit 80 is mounted on the inlet 82 of the tubular member 66 and consists of an angularly displaced abrasive supply conduit 84 that is connected to a supply hose 85 and an air passage 86 which merges with the inlet 82 at the tubular member 66 being separated by a baffle 83. Abrasive is gravity fed through the feed conduit 84 and it is mixed at the inlet 82 with pressurized air flowing through the air passage 86. The pressurized air propels the abrasive through the tubular member 66 with a sufficient initial velocity to carry the abrasive through discharge opening 74 onto the impeller blades 46.

In operation, particulate shot blast material is gravity fed through the feed conduit 84 to the inlet 82 of the tubular member 66. Pressurized air flows through the conduit 86 and merges with the particulate shot at the inlet 82. The pressurized air propels the abrasive shot through the main portion 68 and the discharge extension 72 of the tubular member 66. A portion of the abrasive strikes the deflector projection 76 which other portions hitting the upright wall 75 so that when the abrasive is discharged from the discharge extension 72 at the opening 74 it will be evenly distributed onto the impeller blades 46. Because the axis 70 is located above the axis 48, pressurized air carries the abrasive shot a relatively short distance outwardly to the impeller blades 46. Thus, a more efficient utilization of the pressurized air is realized resulting in the use of less energy to propel the abrasive from the inlet 82 of the tubular member 66 onto the impeller blades 46.

An improved shot blast pattern is provided by the apparatus 10. Use of the shortened impeller blades 46 reduces the amount of travel over the blades 46 by the shot which reduces the likelihood that the even distribution of the abrasive at the ends 52 of the blades will be negated as the shot travels over the blades 46. Consequently, the blasting apparatus 10 reduces the chances that a hot spot or overblasting will occur when a workpiece is being treated.

From the above description, it can be seen that an improved centrifugal shot blast apparatus is provided which requires a reduced amount of energy to pneumatically feed abrasive onto the impeller blades. The cooperation between the shortened impeller blades 46 and the offset position of the tubular member 66 enables the reduced amount of energy to be expended in feeding the abrasive onto the impeller blades 46. Also, use of the shortened impeller blades 46 provides an improved shot blast pattern.

It is claimed:

1. In a centrifugal blasting machine, a rotatably supported member having a plurality of outwardly extending abrasive impelling blades projecting therefrom, the inner ends of said blades terminating at positions spaced a uniform and predetermined distance short of the axis of rotation of said member so as to define an abrasive supply space between the inner ends of said blades, a tubular member extending into said supply space for delivering abrasive to the inner ends of said blades, said tubular member having an axis generally parallel to said axis of rotation and spaced radially outwardly therefrom, an extension on the inner end of said tubular member extending radially outwardly relative to said tubular member axis and said axis of rotation and terminating in a closely spaced relation with the inner ends of said blades, and means for delivering air under pressure and abrasive to said tubular member.

2. The centrifugal blasting machine according to claim 1, wherein said predetermined distance is greater than the length of each blade.

3. The centrifugal blasting machine according to claim 1 and further including an abrasive feed spout in communication with said tubular member for feeding abrasive thereto.

4. The centrifugal blasting machine according to claim 1, wherein said tubular member includes a deflector projection on said extension operable to deflect at least portions of the abrasive being conveyed through said tubular member so that the abrasive discharging from said tubular member onto said blades strikes said blades with a selected distribution pattern over the widths of the blades.

* * * * *